US007228982B2

(12) United States Patent
Nielson

(10) Patent No.: US 7,228,982 B2
(45) Date of Patent: Jun. 12, 2007

(54) RING HANDLE FOR BOTTLES

(76) Inventor: Keith M Nielson, 4905 Westchester Dr., Traverse City, MI (US) 49684

( * ) Notice: Subject to any disclaimer, the term of this patent is extended or adjusted under 35 U.S.C. 154(b) by 229 days.

(21) Appl. No.: 11/011,726

(22) Filed: Dec. 14, 2004

(65) Prior Publication Data

US 2006/0124579 A1 Jun. 15, 2006

(51) Int. Cl.
*B65D 23/10* (2006.01)

(52) U.S. Cl. ..... 215/396; 215/397; 220/758; 220/759; 220/769; 294/31.2

(58) Field of Classification Search ..... 215/396–398; 294/31.2, 27.1, 33; 220/759, 769, 758
See application file for complete search history.

(56) References Cited

U.S. PATENT DOCUMENTS

| | | | | |
|---|---|---|---|---|
| D044,732 | S | | 10/1913 | Redington |
| 1,338,480 | A | | 4/1920 | Allenberg |
| 1,550,618 | A | * | 8/1925 | Kemp ..... 220/710.5 |
| D107,542 | S | | 12/1937 | Moore et al. |
| 2,307,390 | A | * | 1/1943 | Chew ..... 215/398 |
| 2,441,892 | A | * | 5/1948 | Mattoon ..... 294/31.2 |
| D172,718 | S | | 7/1954 | Musel et al. |
| 2,760,808 | A | * | 8/1956 | Moyer et al. ..... 294/31.2 |
| 2,967,071 | A | * | 1/1961 | Deschene ..... 294/31.2 |
| D189,730 | S | | 2/1961 | Williams et al. |
| D189,768 | S | | 2/1961 | Menghi |
| D192,580 | S | | 4/1962 | Sheltmire |
| D194,068 | S | | 11/1962 | Pettingill |
| D194,806 | S | | 3/1963 | Kracht, Jr. |
| D194,998 | S | | 4/1963 | Miller |
| 3,086,671 | A | | 4/1963 | Zaleski |
| D196,001 | S | | 8/1963 | Zaleski |
| D196,145 | S | | 8/1963 | Kinsley |
| D196,273 | S | | 9/1963 | Suess |
| D198,704 | S | * | 7/1964 | Meagher ..... D7/393 |
| D205,479 | S | | 8/1966 | Certo |
| D210,854 | S | | 4/1968 | Anderson |
| D213,948 | S | | 4/1969 | Anderson |
| D214,552 | S | | 7/1969 | Hills |
| 3,463,536 | A | | 8/1969 | Updegraff et al. |
| D215,411 | S | | 9/1969 | Anderson |
| D219,867 | S | | 2/1971 | Reimer |
| D220,468 | S | | 4/1971 | Gould |
| D220,867 | S | | 6/1971 | Wright |
| D223,896 | S | | 6/1972 | Frazer |
| D229,671 | S | | 12/1973 | Nelson |

(Continued)

OTHER PUBLICATIONS

Design #2075251 Bibliography.

*Primary Examiner*—Sue A. Weaver
(74) *Attorney, Agent, or Firm*—Van Dyke, Gardner, Linn & Burkhart, LLP

(57) ABSTRACT

The present invention is directed toward a bottle handle that is separately formed and subsequently affixed to the neck of a bottle by threading, or snap fitting the handle onto the bottle neck, or by securing thereto during a blow mold operation of the bottle. The preferred handle includes a neck portion and a finger portion that comprise two generally perpendicularly oriented, substantially circular rings that are offset from one another in an approximately tangential relationship. Protuberances and concave finger indents on the finger portion enable a user's finger to provide extra support when handling a bottle affixed with the bottle handle.

10 Claims, 6 Drawing Sheets

U.S. PATENT DOCUMENTS

| | | | | | |
|---|---|---|---|---|---|
| D232,077 | S | | 7/1974 | Strand | |
| D238,143 | S | | 12/1975 | Bay | |
| D239,366 | S | | 3/1976 | Lasseaux | |
| 3,990,596 | A | | 11/1976 | Hoftman | |
| D252,186 | S | | 6/1979 | Moller | |
| 4,197,960 | A | | 4/1980 | Walter | |
| 4,220,079 | A | * | 9/1980 | Sims | 99/295 |
| D257,578 | S | | 12/1980 | Hayes | |
| D258,491 | S | | 3/1981 | Hayes | |
| 4,273,246 | A | | 6/1981 | Thompson | |
| D265,159 | S | | 6/1982 | La Barbera | |
| 4,368,826 | A | | 1/1983 | Thompson | |
| D273,661 | S | | 5/1984 | Widmer | |
| D276,504 | S | * | 11/1984 | Moran et al. | D9/434 |
| D282,440 | S | | 2/1986 | Gordon, Jr. | |
| 4,834,252 | A | * | 5/1989 | Crisci | 215/256 |
| 4,936,614 | A | | 6/1990 | Russell | |
| D328,253 | S | | 7/1992 | Poore et al. | |
| D340,640 | S | | 10/1993 | Ferguson et al. | |
| 5,297,686 | A | * | 3/1994 | Takeuchi | 215/396 |
| 5,487,482 | A | * | 1/1996 | Rocheleau | 215/396 |
| D369,499 | S | | 5/1996 | Scott et al. | |
| 5,573,152 | A | | 11/1996 | Arnold | |
| 5,655,805 | A | * | 8/1997 | Shaddy | 294/31.2 |
| D391,167 | S | | 2/1998 | Beshara, Jr. | |
| D391,856 | S | | 3/1998 | Lynd | |
| D395,205 | S | | 6/1998 | Inwood et al. | |
| D403,968 | S | | 1/1999 | DeVore | |
| 5,862,953 | A | * | 1/1999 | Long, Jr. | 222/153.06 |
| D429,155 | S | | 8/2000 | Beale | |
| 6,179,143 | B1 | | 1/2001 | Grob | |
| 6,338,415 | B1 | | 1/2002 | Grob | |
| 6,364,385 | B1 | | 4/2002 | Steward et al. | |
| 6,394,517 | B1 | | 5/2002 | Borg | |
| D469,018 | S | | 1/2003 | Allanson et al. | |
| 6,554,602 | B2 | | 4/2003 | Deemer et al. | |
| 6,607,680 | B1 | | 8/2003 | Moitzheim | |
| 2002/0084240 | A1 | | 7/2002 | Yu-Hsien | |

* cited by examiner

FIG. 4
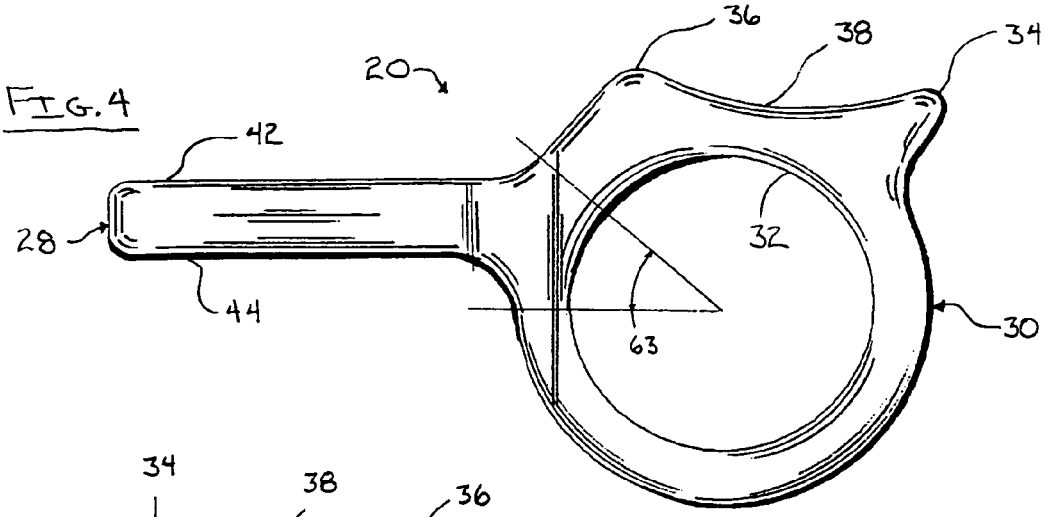
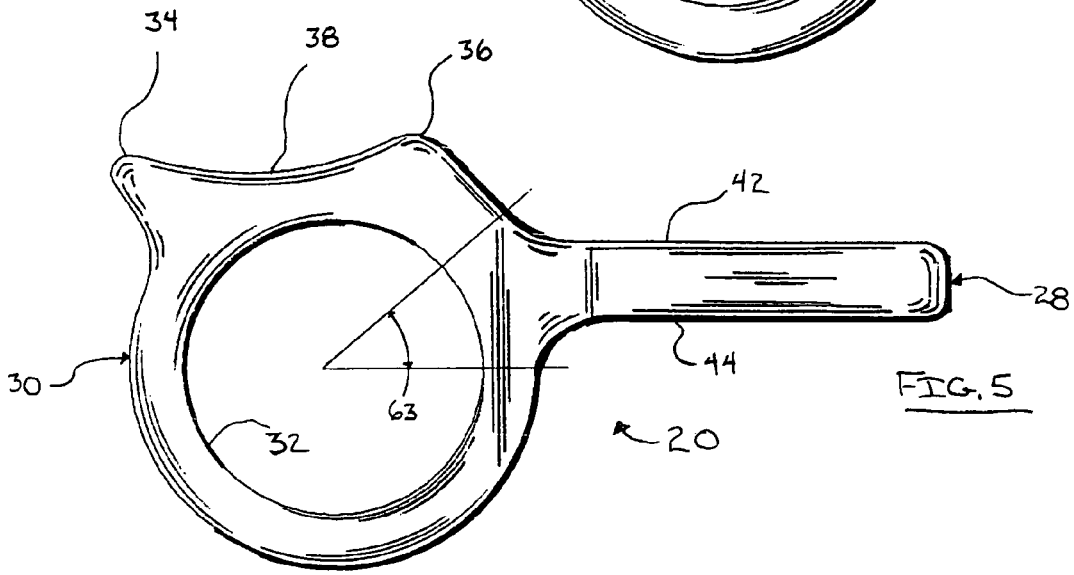
FIG. 5
FIG. 6
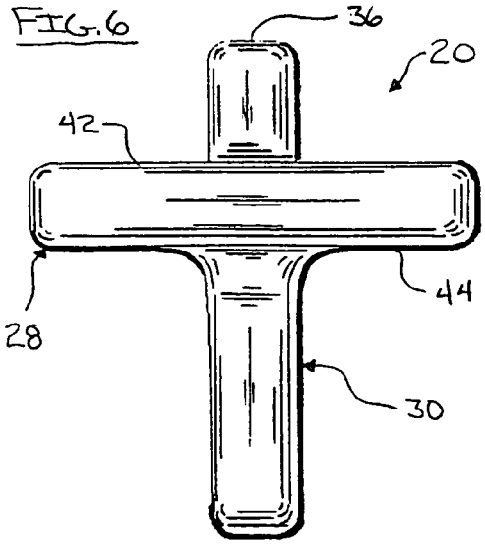
FIG. 7
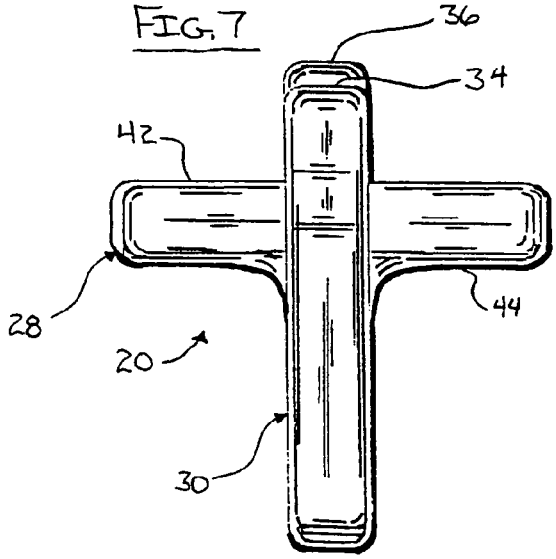

46
42
36
38

A
A
62
34
65
20
30
28

28

62
44
34
65
20
30
46

36
34
38

54
52
60
48
46
42
48
60
28
44
58
50
56
62
50
58
32
20
30

FIG. 11
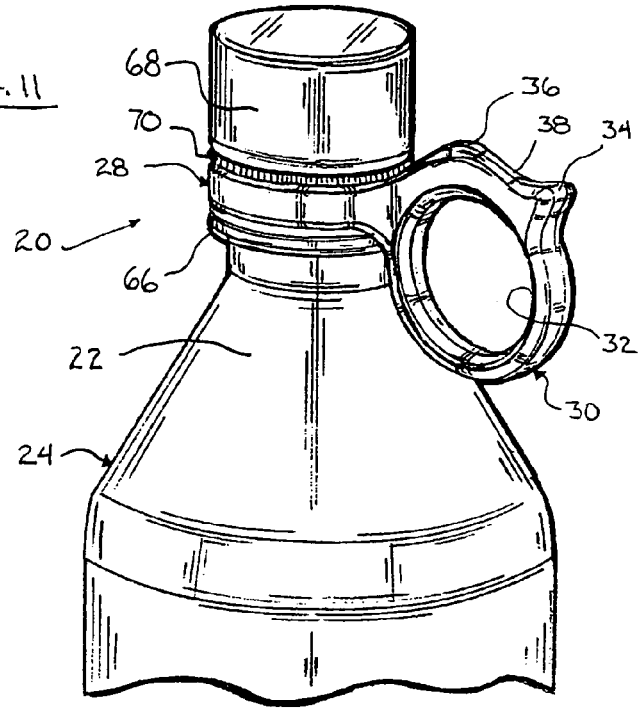
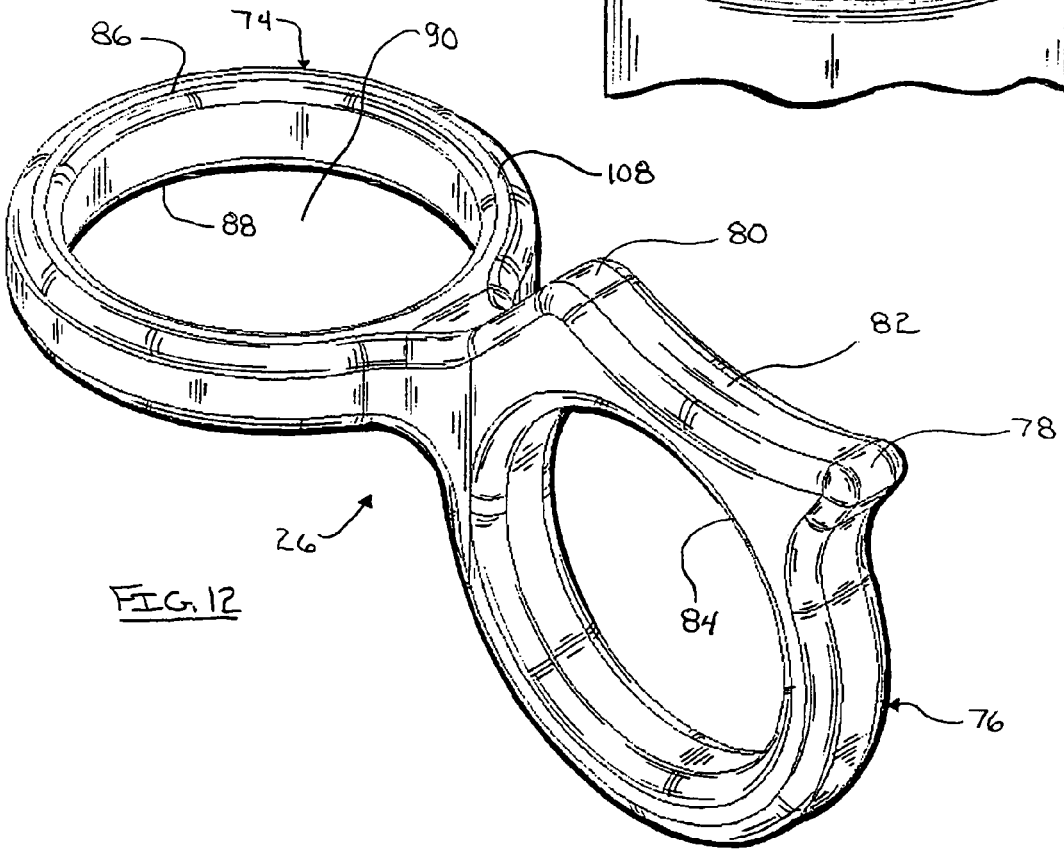
FIG. 12

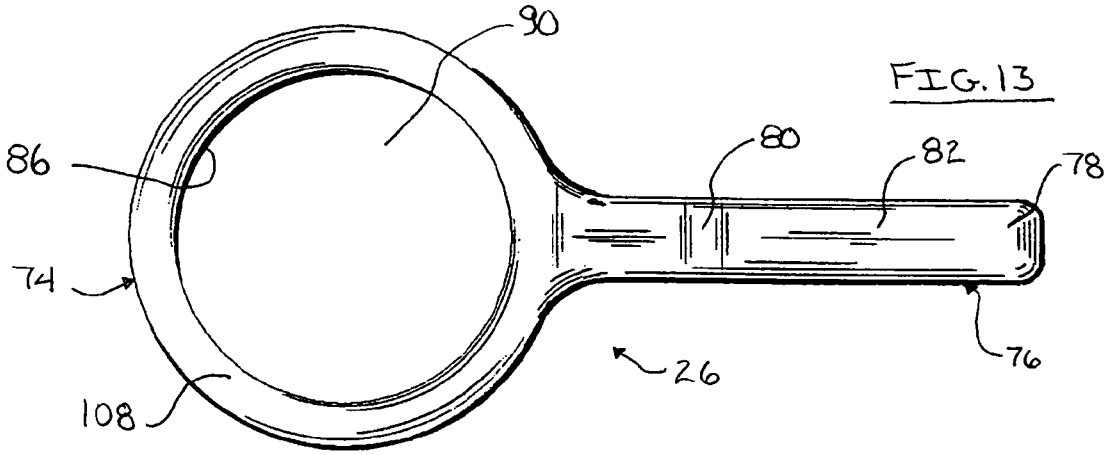
FIG. 13
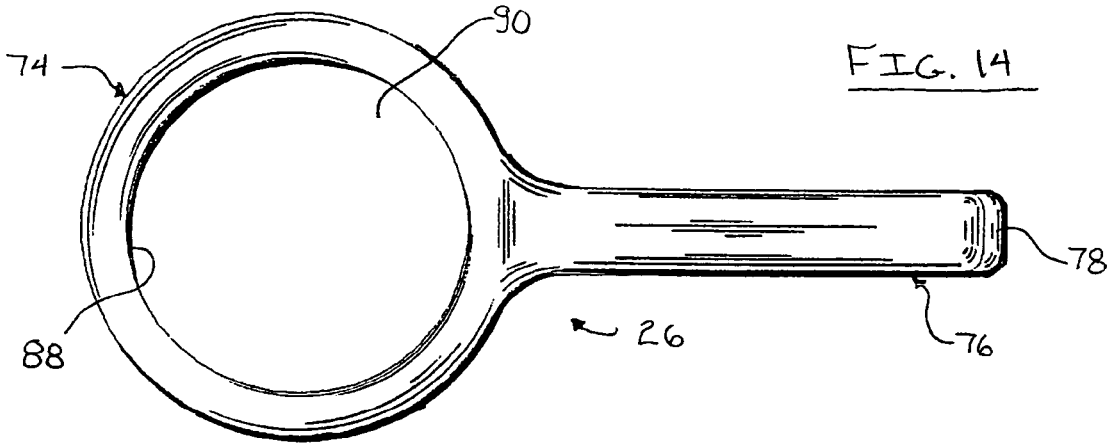
FIG. 14
FIG. 15
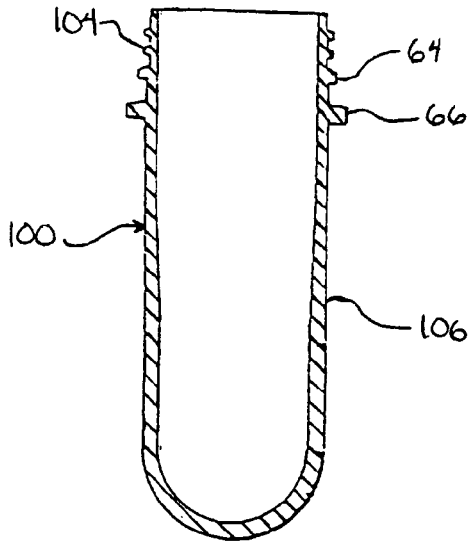

RING HANDLE FOR BOTTLES

BACKGROUND OF THE INVENTION

Bottles are commonly used to store, carry, and dispense a wide variety of liquids. The consumer beverage market represents one area in which an extensive number of beverages, such as carbonated and non-carbonated drinks, are produced and sold in bottles annually. Amongst other types of bottles, blow molded plastic bottles are frequently used for such beverages as they are cost effective to manufacture and provide a reliable and healthy method of distributing such products. Furthermore, blow molded plastic bottles may be produced in a wide variety of shapes and sizes Although such blow molded bottles are well adapted to store liquids, they do suffer deficiencies. For example, these bottles often must be carried by a user grasping the main portion of the bottle with his or her entire hand as the narrow lips or flanges near the opening of the bottle do not provide an adequate gripping area. Because a user must use their entire hand to carry the bottle, it is more difficult to carry additional items, such as keys, a checkbook, or a lunch box, in the same hand. Furthermore, as consumer beverages are often served cold, the bottles may be coated with condensation, making it even more difficult to maintain a firm grasp on the bottle. In addition, the walls of such bottles are typically thin and, therefore, often collapse if grasped too firmly.

A further difficulty related to such bottles is that it is frequently difficult to pour the liquid contents out of the bottle. Specifically, if a user grasps the bottle in the middle, when the bottle is tipped into a horizontal position the liquid may rush from one end of the bottle to the other and cause an unbalancing wave effect within the bottle. This in turn may cause the liquid to unevenly spurt from the bottle.

It is known to include handles on bottles in an attempt to overcome some of the above referenced deficiencies. However, most of the common shapes for beverage containers leave limited room to include blow molded handles of sufficient strength and shape to carry the bottles. Furthermore, special molds are required to form the handle and it is more difficult to integrally blow mold such handles on bottles, which results in a higher risk that the container will rupture after having been shipped from the bottling plant.

Notwithstanding the above discussed difficulties, it must be noted that the consumer beverage market is a large and competitive market comprising largely similar goods offered by competing bottlers. As such, bottlers seek to differentiate their goods in order to increase their sales.

Therefore, a device is needed that enables a liquid container, such as a beverage bottle, to be more easily carried, enables the liquid to be more easily poured from the bottle, and helps to differentiate the container from those of competitors.

SUMMARY OF THE INVENTION

The present invention is directed toward a device for carrying bottles and pouring the contents there from, and in particular is directed toward handles that are separately formed and subsequently affixed to the necks of bottles.

A bottle handle according to one preferred aspect of the present invention includes a neck portion that is formed as a substantially circular ring adapted to engage the neck of a bottle and a finger portion that is affixed to the neck portion such that the neck portion and finger portion lie in planes that are generally perpendicularly oriented to one another, with the finger portion being formed as a substantially circular ring that includes at least one protuberance adapted to be engaged by the finger of a user.

A bottle handle according to another preferred aspect of the present invention includes a neck portion formed as a substantially circular ring that is adapted to engage the neck of a bottle, where the neck portion includes a top opening, a bottom opening, and an internal bore extending between the top and bottom openings. The bottle handle further includes a finger portion affixed to the neck portion such that the neck portion and finger portion lie in planes that are generally perpendicularly oriented to one another. The finger portion is formed as a substantially circular ring and includes at least one protuberance adapted to be engaged by the finger of a user and the internal bore has a generally constant diameter between the top and bottom openings.

A bottle handle according to yet another preferred aspect of the present invention includes a neck portion formed as a substantially circular ring that is adapted to engage the neck of a bottle, where the neck portion includes a top opening, a bottom opening, and an internal bore extending between the top and bottom openings. The bottle handle further includes a finger portion affixed to the neck portion such that the neck portion and finger portion lie in planes that are generally perpendicularly oriented to one another. The finger portion is formed as a substantially circular ring and includes at least one protuberance adapted to be engaged by the finger of a user. The internal bore is formed by first and second bores, where the first bore is of a larger diameter than the second bore such that a shoulder is formed within the internal bore. The neck portion includes a lip surrounding the top opening such that the lip, first bore, and shoulder form a groove within the internal bore. A plurality of tabs that extend inwardly towards the center of the internal bore are affixed to the first bore proximate to the shoulder.

The bottle handle of the present invention enables bottles to be conveniently carried and poured due, in part, to the generally perpendicular orientation of the neck portion and finger portion. This orientation allows bottles to be held in a naturally upright position when a user inserts his or her finger or fingers through the finger hole of the finger portion. In addition, the offset relationship of the neck portion to the finger hole provides a more convenient orientation of the finger portion to the opening of the bottle for pouring out or drinking the contents of the bottle. Protuberances and a concave finger indent enable a user's finger, such as a thumb, to provide extra support when handling a bottle, particularly as when pouring out the contents of the bottle. The bottle handle may be readily affixed to bottles by snap fitting or threading the handle onto the bottle, or may be affixed while blow molding the bottle. The resulting bottle handle and bottle provide a consumer with a beverage container that has improved carrying and pouring characteristics. In the highly competitive beverage market, such distinguishing product characteristics may enable a bottler to increase sales.

BRIEF DESCRIPTION OF THE DRAWINGS

FIG. 4 is a right side elevation of the handle of FIG. 3;

FIG. 5 is a left side elevation of the handle of FIG. 3;

FIG. 6 is a front elevation view of the handle of FIG. 3;

FIG. 7 is a rear elevation view of the handle of FIG. 3;

FIG. 11 is a perspective view of the handle of FIG. 1 shown with a cap affixed to the handle;

FIG. 12 is a rear perspective view of the handle of FIG. 2 shown prior to attachment to the bottle;

FIG. 13 is a top plan view of the handle of FIG. 12;

FIG. 14 is a bottom plan view of the handle of FIG. 12; and

FIG. 15 is a cross sectional view of a blow mold preform used to form the bottle of FIG. 2.

DESCRIPTION OF THE PREFERRED EMBODIMENT

Figure 1:
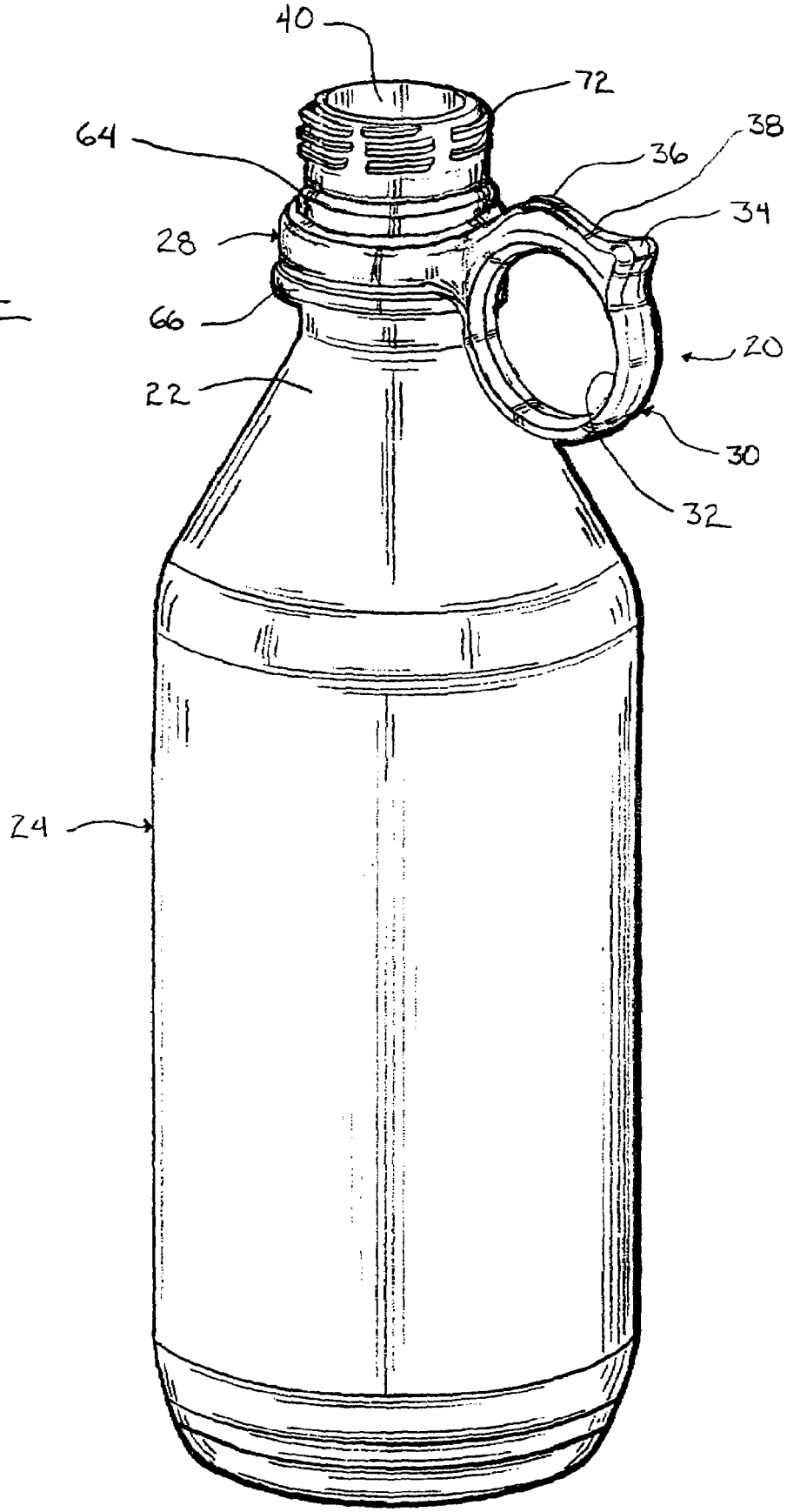
FIG. 1 is a perspective view of a first embodiment of the bottle handle of the present invention shown affixed to a bottle.
Figure 2:
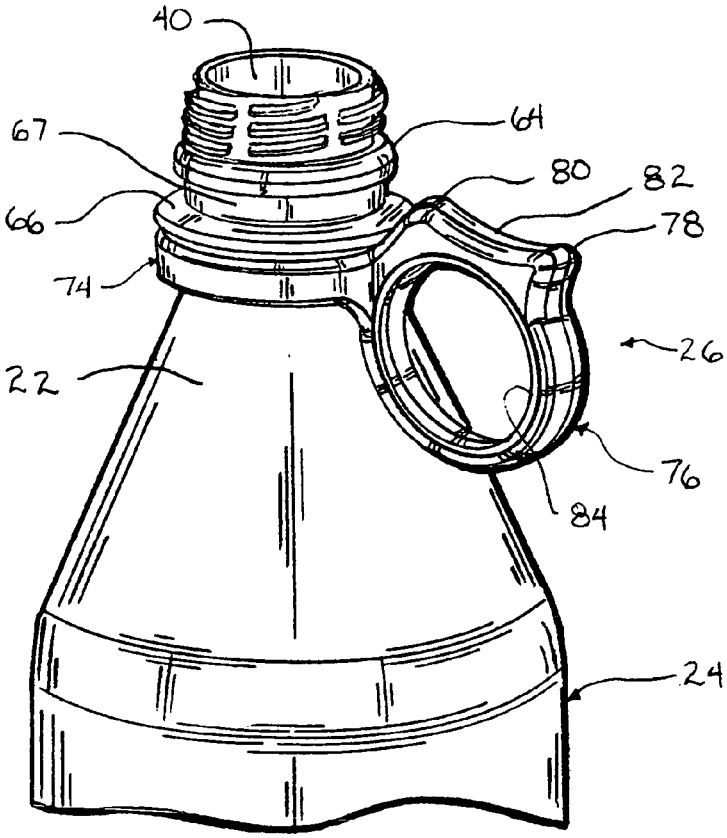
FIG. 2 is a perspective view of a second embodiment of the bottle handle of the present invention show affixed to a bottle.

The present invention is directed toward a device for carrying bottles and pouring the contents there from, and in particular is directed toward a handle that is affixed to the neck of bottles. FIG. 1 discloses a preferred embodiment of the handle of the present invention shown as bottle handle 20 affixed to the neck 22 of a bottle 24. Similarly, FIG. 2 discloses a second preferred embodiment of the handle of the present invention shown as bottle handle 26 affixed to neck 22 of bottle 24. As described in more detail below, bottle handles 20, 26 are formed separately from bottle 24 and are adapted to be affixed to neck 22 during subsequent processing operations of bottle 24. Bottle handles 20, 26 provide a convenient and easy method of holding, carrying, and pouring bottle 24.

Bottle handle 20, as disclosed in FIGS. 1 and 3–10, includes a neck portion or bottle region 28 affixed to a finger portion or handle region 30, where both neck portion 28 and finger portion 30 are formed as substantially circular rings that lie in planes that are generally perpendicular to one another. The generally perpendicular orientation of neck portion 28 and finger portion 30 enable a user to hold bottle 24 in a naturally upright position when the user inserts his or her finger or fingers through the finger hole 32 of finger portion 30.

Finger portion 30, as shown throughout the various views, includes first and second protuberances 34, 36 and a finger receiving indent 38 disposed between first and second protuberances 34, 36. Finger receiving indent 38 is formed as a concave recess that enables a user's finger, such as a thumb, to provide extra support when handling bottle 24, particularly as when pouring out the contents of bottle 24. Although bottle handle 20 is disclosed as having first and second protuberances 34, 36, it should be understood that bottle handle 20 may alternatively be formed with only one protuberance, such as first protuberance 34, and still function to provide added control when handling bottle 24.

First and second protuberances 34, 36 enable a user to exert a torque moment on the periphery of finger portion 30 such that the user's finger or fingers are less likely to slip within finger hole 32 when the user tilts bottle 24. Protuberances 34, 36 and finger receiving indent 38 thereby aid a user when drinking or pouring the contents of bottle 24 by enabling the user to more accurately control the horizontal tilt of bottle 24. As such, a user is able to smoothly dispense the contents of a bottle and avoid the unbalancing wave effect that causes liquid to unevenly spurt from the bottle when the contents rush from the bottom of the bottle to the restricted opening.

As noted, finger portion 30 also includes finger hole 32. With respect to the orientation of neck portion 28 to finger hole 32, FIGS. 4 and 5 disclose that neck portion 28 lies in a plane that does not pass through the center of finger hole 32, but rather lies in a plane that is offset above the center of finger hole 32 towards first and second protuberances 34, 36 in an approximately tangential relationship to finger hole 32. When bottle handle 20 is assembled to bottle 24, the offset relationship of neck portion 28 to finger hole 32 provides a more convenient orientation of finger portion 30 to the opening 40 of bottle 24 for a user to pour or drink the contents of bottle 24.

Figure 3:
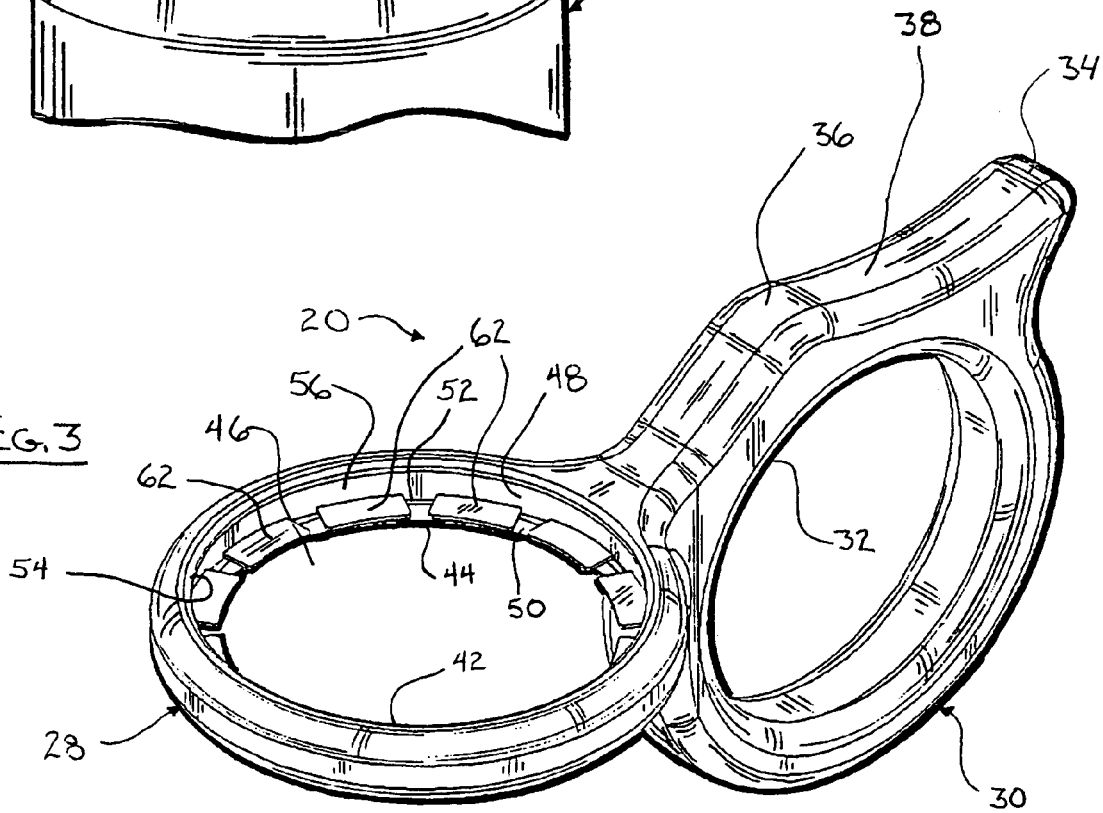
FIG. 3 is a front perspective view of the bottle handle of FIG. 1 shown prior to attachment to the bottle.
Figure 8:
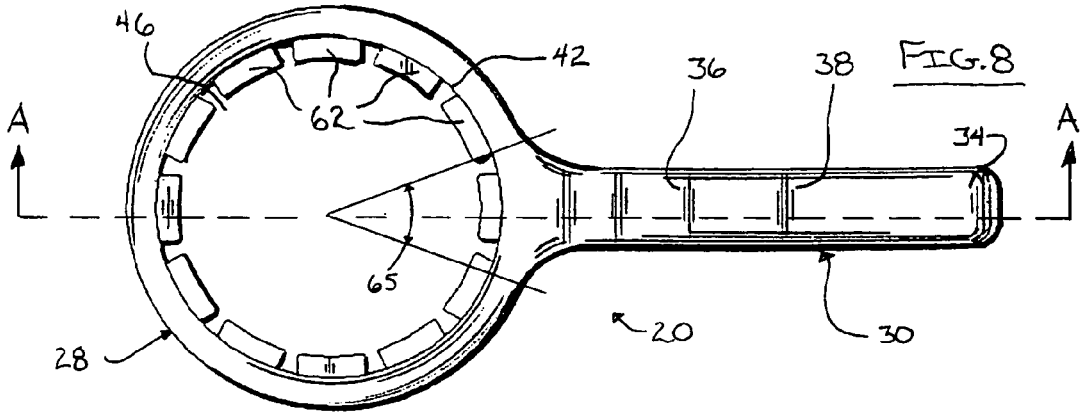
FIG. 8 is a top plan view of the handle of FIG. 3.
Figure 9:
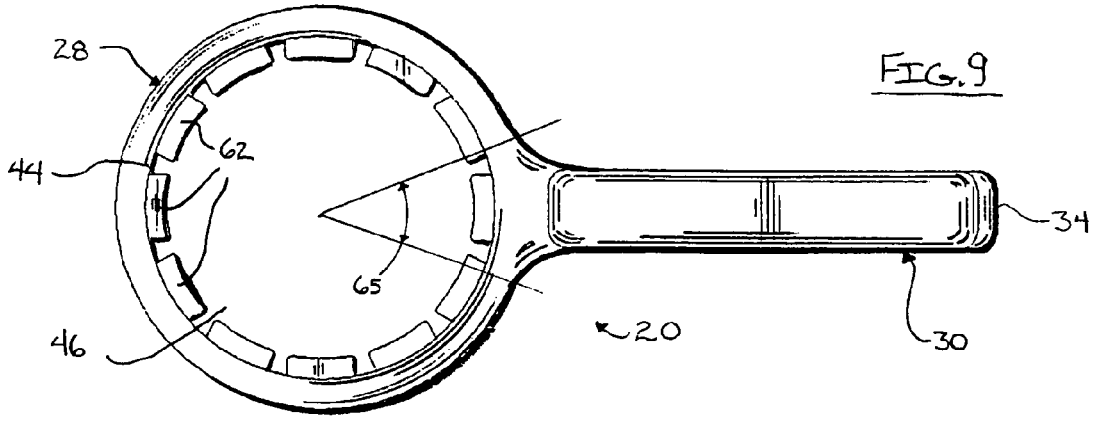
FIG. 9 is a bottom plan view of the handle of FIG. 3.
Figure 10:
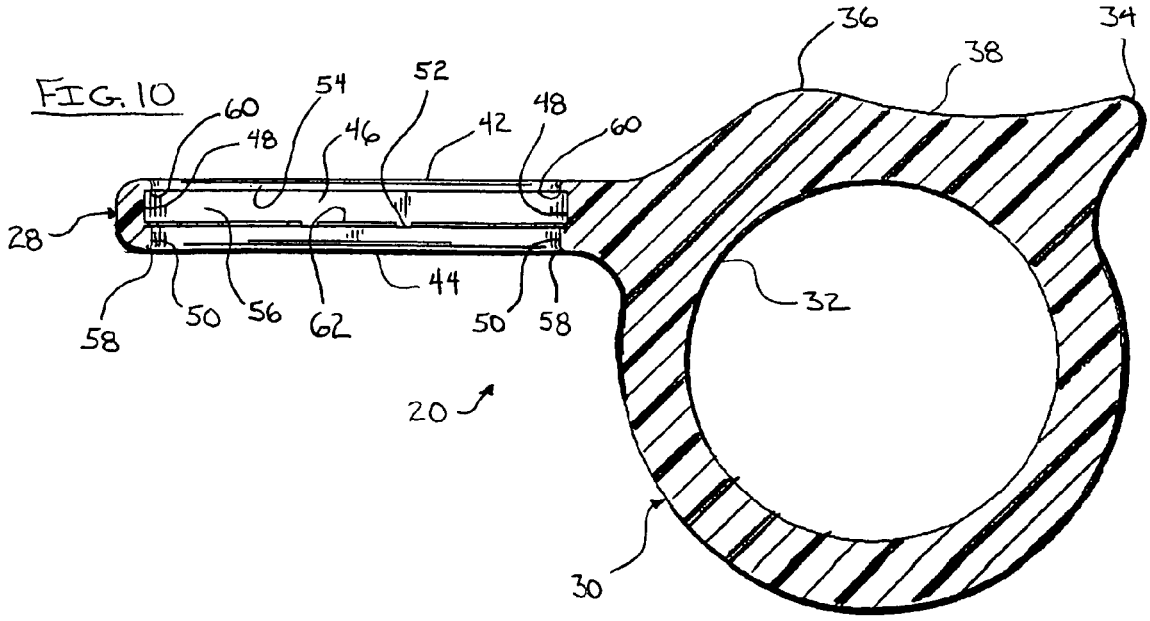
FIG. 10 is a sectional view along the line A—A of FIG. 8.

Neck portion 28 of bottle handle 20 includes both a top opening 42 and a bottom opening 44 such that an internal bore 46 extends between the top and bottom openings 42, 44. As best seen in FIGS. 3 and 10, internal bore 46 includes first and second bores 48, 50, where first bore 48 is of a greater diameter than second bore 50 such that a shoulder 52 is formed within internal bore 46. Neck portion 28 further includes, as best seen in FIG. 10, a lip 54 surrounding top opening 42. Neck portion 28 thereby includes a groove 56 within internal bore 46, where groove 56 is defined by lip 54, first bore 48, and shoulder 52. FIG. 10 also discloses that edge 58 of second bore 50 and edge 60 of lip 54 are rounded or radiused.

FIGS. 3 and 8–10 further disclose that neck portion 28 of bottle handle 20 includes bottle engagement members, disclosed as tabs 62, positioned within internal bore 46. Tabs 62, as shown in FIG. 10, are affixed to first bore 48 within groove 56 proximate to shoulder 52. Tabs 62 extend inwardly toward the center of internal bore 46 in a generally perpendicular orientation to first bore 48. Notably, tabs 62 are of sufficiently thin construction such that tabs 62 are able to flex or bend.

FIGS. 4, 5, 8, and 9 also disclose that neck portion 28 and finger portion 30 are affixed to one another over limited arcs 63, 65 of their respective substantially ring shaped profiles. As shown, arc 63 and arc 65 form angles of approximately 40 degrees.

In the preferred embodiment, bottle handle 20 is constructed of plastic and is formed by injection molding and subsequently affixed to a pre-made bottle having at least one flange surrounding the neck of the bottle. As shown in FIG. 1, bottle 24 includes upper and lower flanges 64, 66 that are separated by a wall 67 (FIG. 2) that is generally perpendicular to flanges 64, 66. Bottle handle 20 may be assembled to bottle 24 by either threading or snap-fitting bottle handle 20 over upper flange 64, as described below.

Upper flange 64 of bottle 24 is sized to enable internal bore 46 to be pushed over upper flange 64, where radiused edges 58, 60 provide a lead or guide for second bore 50 and lip 54 to pass over upper flange 64. In the preferred embodiment, upper flange 64 may be formed to have a diameter that is approximately the same diameter as second bore 50 and lip 54. As both bottle handle 20 and upper flange 64 of bottle 24 are formed from plastic, second bore 50, lip 54, and upper flange 64 are able to slightly expand and/or compress to allow upper flange 64 to pass through internal bore 46 when second bore 50 and lip 54 form an interference fit with upper flange 64.

As upper flange 64 passes through second bore 50 and into the area of groove 56, tabs 62 are caused to flex upwardly by upper flange 64. Upper flange 64 is formed to be of a diameter and thickness to enable flexible tabs 62 to snap over or past flange 64 and thereby permit lip 54 to be pushed over upper flange 64. As shown in FIG. 1, when bottle handle 20 is pushed over lip 54 in this manner, bottle handle 20 is located between upper and lower flanges 64, 66 and surrounds wall 67. When so assembled, tabs 62 engage wall 67 of bottle 24 and thereby hold bottle handle 26 snug to neck 22 of bottle 24.

Notably, flexible tabs 62 prevent upper flange 64 from being passed back out of second bore 50 such that bottle handle 20 is effectively locked onto neck 22 of bottle 24. If a user attempts to pull upper flange 64 back through second bore 50, upper flange 64 will cause tabs 62 to flex downwardly and cause tabs 62 to become positioned between upper flange 64 and second bore 50. Therefore, in order to remove bottle handle 20 from bottle 24, upper flange 64 would have to pass over flexible tabs 62 while they are located within second bore 50. As a result, the diameter of second bore 50 through which upper flange 64 must pass is effectively reduced by the presence of tabs 62 being forced into second bore 50 by upper flange 64. Although upper flange 64 and second bore 50 are able to slightly compress and expand, they are not able to compress and expand to a degree that would enable upper flange 64 to pass through the reduced diameter of second bore 50 caused by the added interference of tabs 62 within second bore 50. Therefore, bottle handle 20 is effectively locked to bottle 24 by flexible tabs 62.

As shown in FIG. 11, bottle handle 20 may alternatively be constructed to include cap 68. Cap 68 is detachably affixed to neck portion 28 by multiple breakable prongs 70 and includes internal threads (not shown) that are adapted to engage threads 72 of bottle 24. In this embodiment, bottle handle 20 and cap 68 are formed simultaneously and comprise a unitary piece due to the connection of cap 68 to bottle handle 20 by prongs 70. The combination of cap 68 and bottle handle 20 is subsequently affixed to bottle 24 by threading cap 68 onto bottle 24. Threading cap 68 onto bottle 24 causes neck portion 28 of bottle handle 20 to rotationally pass over upper flange 64 in like manner as described above such that neck portion 28 is located between upper and lower flanges 64, 66.

As described above, flexible tabs 62 prevent removal of bottle handle 20 from bottle 24. Therefore, when cap 68 is twisted for removal, cap 68 moves upward relative to neck portion 28 causing prongs 70 to break, leaving bottle handle 20 affixed to bottle 24 between upper and lower flanges 64, 66. The bottle handle 20 and cap 68 combination of FIG. 11 thus function as a tamper proof safety cap that is intended to be assembled to bottle 24 during the bottling process at, for example, a soft drink bottling plant. The disclosed bottle handle 20 and cap 68 combination thereby provide a consumer with a tamper proof beverage container with improved carrying and pouring characteristics.

As noted above, bottle handle 26 shown in FIG. 2 discloses an alternative embodiment of the present invention. As further shown in FIGS. 12–14, bottle handle 26, as with bottle handle 20, includes a neck portion or bottle region 74 affixed to a finger portion or handle region 76, both of which are formed as substantially circular rings lying in generally perpendicular planes. Although not shown, the left, right, front, and back views of bottle handle 26 of the same geometry to those of bottle handle 20 shown in FIGS. 4–7. Neck portion 74 and finger portion 76 are also affixed to one another over a limited arc of approximately 40 degrees of their respective substantially ring-shaped profiles.

Finger portion 76 of bottle handle 26 also includes first and second protuberances 78, 80 and a finger receiving indent 82 disposed between first and second protuberances 78, 80. Finger portion 76 includes a finger hole 84, where neck portion 74, similar to the orientation of neck portion 28 to finger hole 32 of bottle handle 20, lies in a plane that does not pass through the center of finger hole 84, but rather lies in a plane that is offset above the center of finger hole 84 towards first and second protuberances 78, 80 in an approximately tangential relationship to finger hole 84.

As with bottle handle 20, protuberances 78, 80 enable a user to exert a torque moment on the periphery of finger portion 76 such that he or she is able to more accurately control the horizontal tilt of bottle 24. Protuberances 78, 80, along with finger receiving indent 82, thereby facilitate the smooth dispensing of the contents of bottle 24.

Neck portion of bottle handle 26 includes both a top opening 86 and a bottom opening 88 such that internal bore 90 extends between top and bottom openings 86, 88. However, in contrast to bottle handle 20 and as shown in FIGS. 13 and 14, internal bore 90 is formed to have a generally constant diameter between top and bottom openings 86, 88.

In the preferred embodiment, bottle handle 26 is constructed of plastic and is formed as by injection molding. As described below, bottle handle 26 is subsequently affixed to a bottle during the blow-molding operation that produces the bottle. As best understood from FIG. 2, bottle handle 26 is caused to be affixed to bottle 24 in between lower flange 66 and neck 22. When bottle handle 26 is secured to bottle 24 in this manner, bottle handle 26 is effectively locked between flange 66 and the bottle neck 22.

The securing of bottle handle 26 to bottle 24 during the blow molding operation of bottle 24 is generally as follows: A polymeric bottle preform 100, as shown in FIG. 15, includes flange 66, threaded spout 104, and unexpanded bottle portion 106, where the outside diameter of unexpanded bottle portion 106 is approximately equal to the diameter of internal bore 90. Bottle portion 106 is inserted through internal bore 90 such that flange 66 contacts top 108 of neck portion 74. Preform 100 and bottle handle 26 are then inserted into a blow mold (not shown) and preform 100 is caused to expand by the blow mold equipment. Upon expansion, bottle portion 106 takes the form of the mold cavity such that bottle 24 is created and bottle handle 26 is thereby secured between flange 66 and neck 22 of bottle 24.

Although the substantially circular rings forming neck portions or bottle regions 28, 74 and finger portions or handle regions 30, 76 are disclosed throughout the various views as being endless, it should be appreciated that neck portions 28, 74 and finger portions 30, 76 may also be broken so as to define a ring with a gap. Such a gap may aid in assembly of bottle handles 20, 26 to bottle 24 or may aid in a user placing a finger within finger portions 30, 76. Furthermore, although neck portions 28, 74 and finger portions 30, 76 are disclosed as being round, it should also be appreciated that they may be formed to have alternative generally circular configurations. For example, neck portions 28, 74 may be formed to mate with a neck of a bottle that is not perfectly round or is formed with an alternative geometry to that of bottle 24. In addition, finger portions 30, 76 may be formed with a larger or alternatively shaped opening, such as an oval or as a pair of oblong partial circles that are slanted with respect to one another.

Although bottle handles 20, 26 are described above in relation to blow molded beverage bottles, it should be readily understood that handles 20, 26 may be used with alternative bottle styles, and materials, and with bottles used to contain alternative contents. Furthermore, bottle handle 26 may be used with alternatively styled preforms other than the disclosed preform 100. Bottle handle 26 may also be adapted to include teeth, tabs, notches, or the like within internal bore 90 such that when preform 100 is expanded, bottle portion 106 is caused to expand into the teeth, tabs, notches, or the like and thereby provide further mechanical engagement of bottle 24 to bottle handle 26.

The bottle handles 20, 26 of the present invention enable bottle 24 to be conveniently carried and poured due, in part, to the generally perpendicular orientation of neck portions 28, 74 to finger portions 30, 76. This orientation enables bottle 24 to be held in a naturally upright position when a user inserts his or her finger or fingers through finger holes 32, 84 of finger portions 30, 76. Furthermore, the offset relationship of neck portions 28, 74 to finger holes 32, 84 provides a more convenient orientation of finger portions 30, 76 to opening 40 of bottle 24 for a user to pour or drink the contents of bottle 24. In addition, protuberances 34, 36, 78, 80 and concave finger receiving indents 38, 82 enable a user's finger, such as a thumb, to provide extra support when handling bottle 24, particularly as when pouring out the contents of bottle 24. The bottle handles 20, 26 of the present invention may be readily affixed to bottle 24 by such methods as snap fitting or threading handle 20 onto bottle 24, or by affixing handle 26 to bottle 24 during the blow molding process. The resulting bottle handles 20, 26 and bottle 24 provide a consumer with a beverage container that has improved carrying and pouring characteristics that, in the highly competitive beverage market, may enable a bottler to increase sales.

The above is a description of the preferred embodiments. One skilled in the art will recognize that changes and modifications may be made without departing from the spirit of the disclosed invention, the scope of which is to be determined by the claims which follow and the breadth of interpretation that the law allows.

The embodiments of the invention in which an exclusive property right or privilege is claimed are defined as follows:

1. A bottle handle, said bottle handle being formed separately from the bottle to which it will be attached and adapted to be affixed to the neck of the bottle, wherein said bottle handle comprises:

a neck portion, said neck portion being formed as a substantially circular ring and adapted to engage the neck of a bottle; and a finger portion affixed to said neck portion such that said neck portion and said finger portion lie in planes that are generally perpendicularly oriented to one another, said finger portion being formed as a substantially circular ring and including at least one protuberance adapted to be engaged by a finger of a user when another finger of the user is received within the substantially circular ring of said finger portion;

wherein said neck portion further includes a top opening, a bottom opening, and an internal bore extending between said top and bottom openings, wherein said internal bore is formed by first and second bores, and wherein said first bore is of a larger diameter than said second bore such that a shoulder is formed within said internal bore, and wherein said neck portion includes a lip surrounding said top opening such that said lip, said first bore, and said shoulder form a groove within said internal bore, and wherein said neck portion includes at least one bottle engagement member projecting generally radically inward from said internal bore;

wherein said bottle handle further includes a plurality of bottle engagement members, wherein said engagement members are affixed to said first bore; and wherein said bottle engagement members are tabs.

2. The bottle handle of claim 1, wherein said finger portion includes first and second protuberances.

3. The bottle handle of claim 2, wherein said finger portion includes a finger receiving indent disposed between said first and second protuberances.

4. The bottle handle of claim 1, wherein said finger portion includes a finger hole, and wherein said neck portion lies in a plane that is approximately tangential to said finger hole.

5. The bottle handle of claim 1, wherein the bottle to which said bottle handle is attachable includes threads, said bottle handle further including a cap and a plurality of attachment prongs, wherein said cap is detachably secured to said neck portion by said prongs, and wherein said cap is adapted to threadably engage the threads on a bottle.

6. A bottle handle, said bottle handle being formed separately from the bottle to which it will be attached and adapted to be affixed to the neck of the bottle, wherein said bottle handle comprises:

a neck portion, said neck portion being formed as a substantially circular ring and adapted to engage the neck of a bottle, said neck portion including a top opening, a bottom opening, and an internal bore extending between said top and bottom openings; and a finger portion, said finger portion being affixed to said neck portion such that said neck portion and said finger portion lie in planes that are generally perpendicularly oriented to one another;

wherein said finger portion is formed as a substantially circular ring and includes at least one protuberance adapted to be engaged by the finger of a user, and wherein said internal bore is formed by first and second bores, wherein said first bore is of a larger diameter than said second bore such that a shoulder is formed within said internal bore, and wherein said neck portion includes a lip surrounding said top opening such that said lip, said first bore, and said shoulder form a groove within said internal bore, and wherein said neck portion includes a plurality of tabs affixed to said first bore proximate to said shoulder, said tabs extending inwardly towards the center of said internal bore.

7. The bottle handle of claim 6, wherein said finger portion includes first and second protuberances.

8. The bottle handle of claim 7, wherein said finger portion includes a finger receiving indent extending between said first and second protuberances.

9. The bottle handle of claim 6, wherein said finger portion includes a finger hole, and wherein said neck portion lies in a plane that is approximately tangential to said finger hole.

10. The bottle handle of claim 6, wherein the bottle to which said bottle handle is attachable includes threads, said bottle handle further including a cap and a plurality of attachment prongs, wherein said cap is detachably secured to said neck portion by said prongs, and wherein said cap is adapted to threadably engage the threads on a bottle.

* * * * *

UNITED STATES PATENT AND TRADEMARK OFFICE

CERTIFICATE OF CORRECTION

PATENT NO. : 7,228,982 B2
APPLICATION NO. : 11/011726
DATED : June 12, 2007
INVENTOR(S) : Keith M. Nielson It is certified that error appears in the above-identified patent and that said Letters Patent is hereby corrected as shown below:

In the Claims

Column 7
Line 64, Claim 1, "radically" should be --radially--

Signed and Sealed this
Thirty-first Day of December, 2013

Margaret A. Focarino

Margaret A. Focarino
*Commissioner for Patents of the United States Patent and Trademark Office*